US007121547B1

(12) United States Patent
Stevens

(10) Patent No.: US 7,121,547 B1
(45) Date of Patent: Oct. 17, 2006

(54) CARROMBOARD ADAPTED FOR CHALLENGING PLAYERS OF VARYING SKILL

(76) Inventor: William H. Stevens, 1704 W. Lakewood Ave., Durham, NC (US) 27707

( * ) Notice: Subject to any disclaimer, the term of this patent is extended or adjusted under 35 U.S.C. 154(b) by 0 days.

(21) Appl. No.: 11/230,703

(22) Filed: Sep. 20, 2005

(51) Int. Cl.
*A63B 7/36* (2006.01)

(52) U.S. Cl. ..... 273/126 R

(58) Field of Classification Search ..... 273/118 R, 273/118 A, 123 R, 123 A, 126 R, 108; 473/7, 473/20, 28

See application file for complete search history.

(56) References Cited

U.S. PATENT DOCUMENTS 602,179 A * 4/1898 Haskell ..... 273/123 R
1,119,753 A * 12/1914 Hansen ..... 273/123 R
1,349,587 A * 8/1920 Smith et al. ..... 273/126 R
1,962,576 A * 6/1934 Von Stackelberg ..... 273/126 R
2,809,040 A * 10/1957 Trovato ..... 473/3
4,017,079 A 4/1977 Apellaniz ..... 273/126 R
4,146,228 A * 3/1979 Laciste ..... 273/126 R
4,283,054 A * 8/1981 Patella et al. ..... 273/126 R
4,318,543 A * 3/1982 Vollendorf ..... 473/7
4,548,409 A 10/1985 Cacho ..... 273/126 R
4,909,507 A * 3/1990 McKnown ..... 473/28
5,039,099 A * 8/1991 Bravo ..... 273/126 A
5,131,664 A * 7/1992 Medina ..... 473/16
5,154,419 A * 10/1992 Madhavan ..... 273/126 R

OTHER PUBLICATIONS

Undated Literature Showing Prior Art Corner Construction of Carrom Tournament Board (2 pages).

* cited by examiner

*Primary Examiner*—Raleigh W. Chiu
(74) *Attorney, Agent, or Firm*—Olive & Olive, P.A.

(57) ABSTRACT

A rectangular carromboard provides a vertically adjustable impact surface outward of each pocket, positioning of which enables the player of the game to be presented with playing situations of varying difficulty.

12 Claims, 3 Drawing Sheets

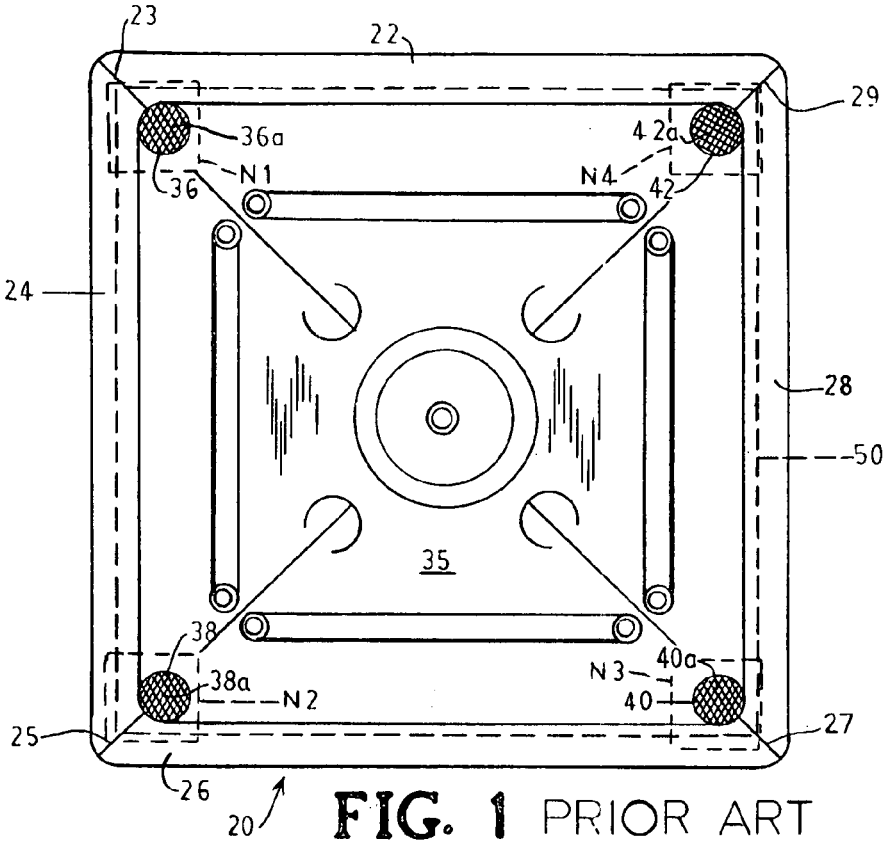
FIG. 1 PRIOR ART
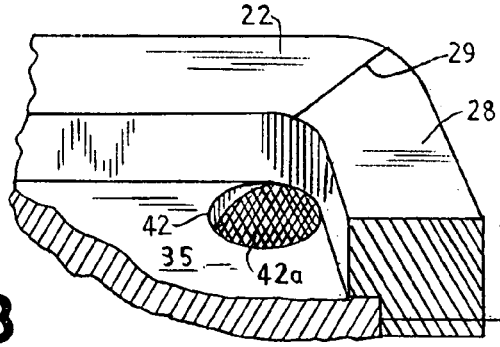
FIG. 2
PRIOR ART
FIG. 3
PRIOR ART
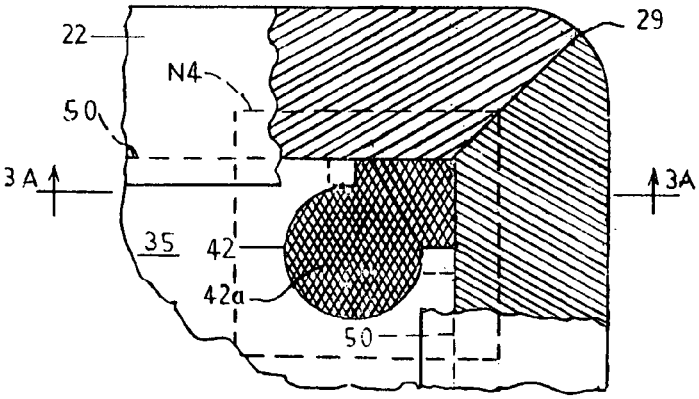
FIG. 3A
PRIOR ART
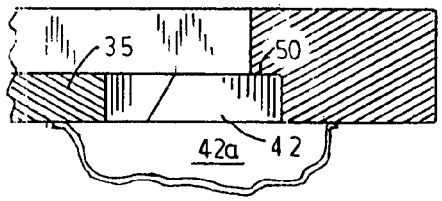

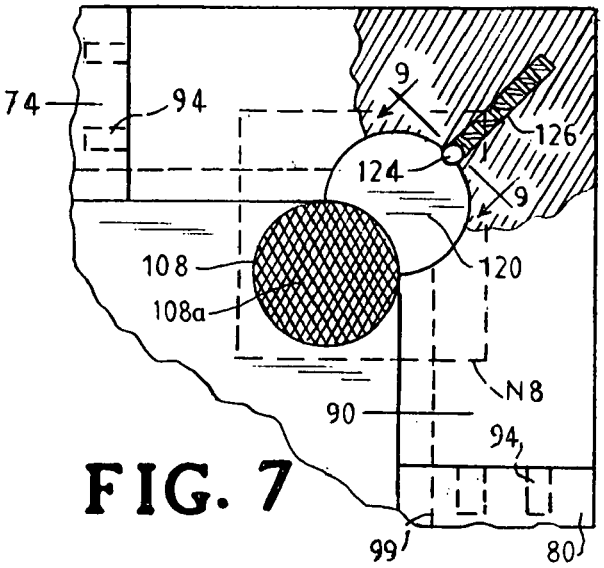
FIG. 7
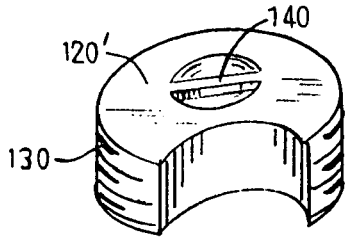
FIG. 12
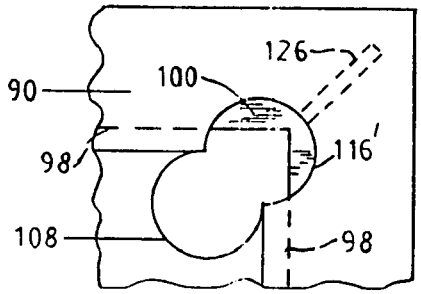
FIG. 8
FIG. 9
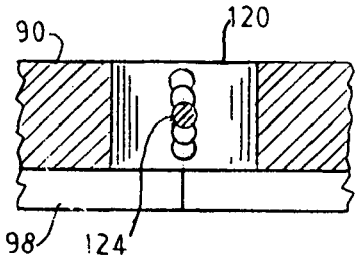
FIG. 10
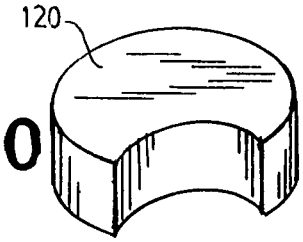
FIG. 11
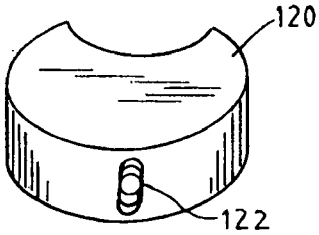

CARROMBOARD ADAPTED FOR CHALLENGING PLAYERS OF VARYING SKILL

FIELD OF INVENTION

An improved carromboard for playing international standard carrom is fitted at each corner with a vertically adjustable impact member whose inner surface, by vertical adjustment, creates different levels of difficulty for scoring and thus adapts to players of varying skill.

BACKGROUND OF INVENTION

Applicant has identified two major obstacles to the popular expansion of the carrom game. The first has to do with the manufacture of the frame, which requires a curved inner surface behind each pocket. A known way to make this inner corner involves joining four pieces of hardwood at the corners with high-quality dovetail joints and then routing out the inner edge of the frame so as to provide an inner curved surface at each of the corners. This way of making the inner corner however, is expensive and labor intensive since it requires equipment capable of accuracy of detail and an experienced, skilled operator to produce a high quality frame. This way is also wasteful of raw material since the routed-out portion is reduced to dust. In South Asian countries, where routing equipment and experienced technicians are not readily available, manufacturers of carromboards solve this problem by carving a corner piece by hand, which they insert into a keyhole at each corner. While this alternative way of making the inner corner is more labor-intensive than the first method mentioned, it requires no exceptional skill. Since the cost of South Asian labor is relatively inexpensive as compared to the cost of labor in the United States, the inner carved corner fabrication technique is used by virtually all South Asian manufacturers. A carved corner piece can however work loose. Therefore, most Western makers of carromboards have abandoned the carving technique in favor of the routing technique. One European manufacturer, Carat Carrom of Switzerland, creates the inner corner by making an insert whose outer vertical surface follows a round contour and whose inner surface follows the round contour of the pocket. This specially shaped insert is placed in a large hole that is drilled in each corner of the frame with a hole saw and is glued into place.

Aside from the obstacle created by the way the frame is manufactured as discussed above, the other major obstacle to the widespread popularization of international standard carrom to the American public is the inherent difficulty of the game. Although this is a positive attribute as far as promotion among game enthusiasts and serious players of pool, billiards and snooker, it is a handicap when trying to interest and excite new players. Since the pockets are so small in diameter, it requires a high degree of accuracy to propel the coins in the right direction. The margins of error in the trajectories of both striker and coin are very precise with the result that a slight inaccuracy in the striking produces a miss in the pocket.

This difficulty of international standard carrom is compounded by the presence of a hardwood frame surface in back of each pocket the effect of which is to cause a coin to bounce back out over the pocket if hit too hard. Accuracy of force is therefore an equally important component of carrom skill, along with accuracy of aim, as a perfectly aimed shot can often miss due to excessive speed. The ability to control speed of the coin can be very frustrating for beginners and it is applicant's observation that aim improves quite rapidly for novices whereas speed is much more difficult to bring under control. On the other hand, this is also what makes international standard carrom so appealing to serious game players. It rewards skill, finesse, and practice making a perfectly executed shot, from the standpoint of both trajectory and speed, an enormously satisfying accomplishment.

The high degree of difficulty in playing international standard carrom, as discussed above, is a major factor in the need for improvements on the principal and substantially only type of carromboard sold in the United States of America since 1898 by the Carrom Company under the name "Carrom". Promotional literature produced by the Carrom Company indicates that its carrom game product was "inspired by a game played in India for centuries" but was then modified by the Company's founder, Henry Haskell, to make it more suitable and easier for play by American players. As a result, the pocket sizes were made larger and the frame made thinner, the result of which was to substantially eliminate any bounce back over the pockets. Haskell's modifications of the pockets assured success for beginners, as speed was eliminated as a factor of accuracy and the angle of deflection was greatly enlarged. Thus, the game was made easier for novices while eliminating the challenge for advanced players that made the original Indian game, now the international standard, so competitive.

The primary object of the present invention is thus to provide a corner-pocket assembly that will overcome the obstacle presented by the existing type of corner-pocket assembly for beginning players while keeping the game challenging for more advanced players. The object of the invention can also be said to be to create a standardized carromboard on which all skill levels, from novice to tournament player, can be satisfied and/or incrementally challenged particularly when playing according to the international standards. At the same time, a further object of the invention is to provide a carromboard that is easier and more cost-effective to manufacture, so as to be able to provide entry-level as well as advanced boards at a reasonable cost.

Other objects will become apparent as the description proceeds.

SUMMARY OF THE INVENTION

An improved carromboard according to the invention comprises:

(i) a rectangular carromboard the sides of which are bounded by rails and over the smooth, flat bed on which flat, disc-like game pieces referred to as "coins" slide;

(ii) a pocket comprising a hole fixed in position, passing through the playing surface of the board, and located within the rails at each corner of the board and below the hole;

(iii) a net or other means for receiving and holding game pieces shot therein, the rails at each corner of the board being formed as part of a corner assembly; and (iv) each said corner assembly being formed with an opening located outwardly of the respective pocket hole associated with the assembly and in which is mounted a vertically adjustable impact member shaped to fit said opening, said member having an outwardly curved, impact surface facing the respective said hole and located in a curved plane which substantially coincides with the curved plane occupied by an outer portion of the periphery of the entry to a pocket therebelow where by adjusting the vertical position of said impact member, a variation in the difficulty of pocketing a game piece in a particular pocket hole can be varied.

BRIEF DESCRIPTION OF DRAWINGS

FIG. 1 is a plan view of an international standard carromboard according to the prior art.

FIG. 2 is a perspective view of a corner-pocket assembly according to the prior art.

FIG. 3 is a plan view with portions of the side rails broken away, indicating how the surfaces surrounding the outer periphery of the pocket are typically formed according to the prior art.

FIG. 3A is a sectional view taken substantially along line 3A—3A of FIG. 3.

FIG. 7 is a plan view, with a portion of the corner assembly broken away, of the improved corner construction of the invention incorporating a spring loaded detent.

FIG. 8 is a plan view of a portion of the corner assembly structure of FIG. 7 with the net and impact member removed and with a portion of the rail left in place serving as a stop to limit downward travel of the impact member.

FIG. 9 is fragmentary section view of the outer surface of the impact member taken in the direction of line 9—9 of FIG. 7.

FIG. 10 is a front perspective view of the invention impact member.

FIG. 11 is a rear perspective view of the invention impact member shown in FIG. 10.

FIG. 12 is a front perspective view of an alternative embodiment impact member which is threaded and is formed with a finger adjusting means in the top thereof.

DETAILED DESCRIPTION OF INVENTION

Figure 4:
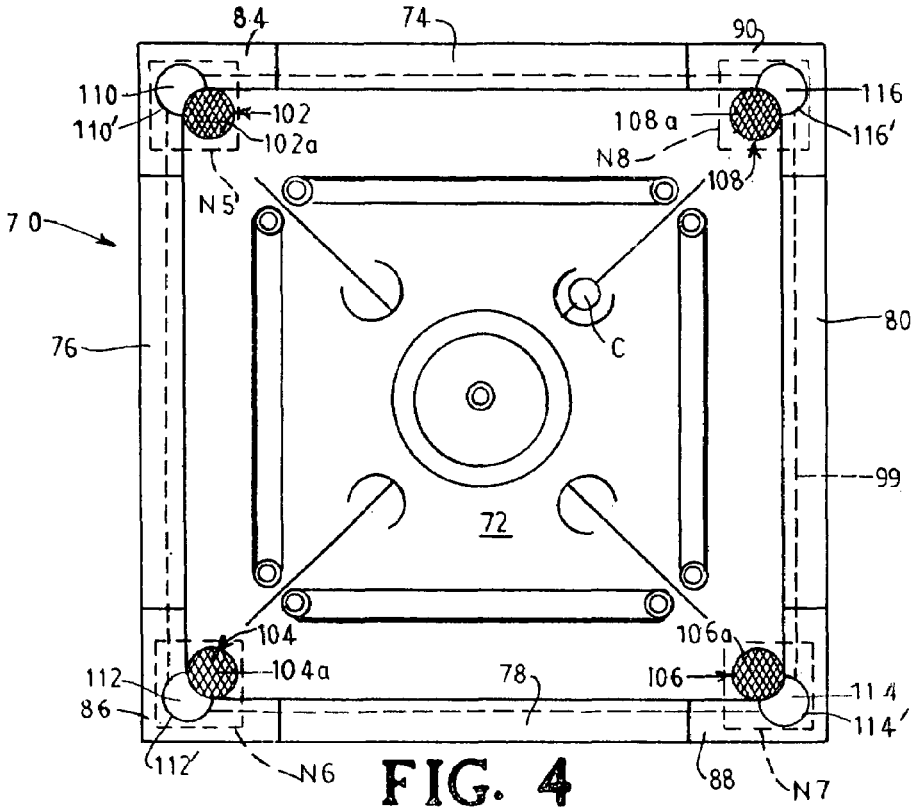
FIG. 4 is a plan view of a carromboard constructed according to the invention and showing the ideal path of a coin.

A plan view of a carromboard, according to prior art construction, indicates the carromboard 20 as having four side rails 22, 24, 26 and 28 joined to each other at the board's corners by respective mitered joins 23, 25, 27 and 29 and mounted on a smooth, flat bed 35 on which the flat disc like game pieces, referred to as "coins" C (FIG. 4) are forced to slide. Circular pockets 36, 38, 40 and 42 with appended nets 36*a*, 38*a*, 40*a* and 42*a* are formed at each of the four corners of the bed 35 which is inset into a dado notch 50 as indicated in the illustrated prior art construction. The net boundaries are indicated by the dashed lines N1, N2, N3 and N4.

A plan view of the present invention improved carromboard 70 is seen in FIG. 4 in which there is illustrated the bed 72 of the game board 70 bounded by rails 74, 76, 78 and 80. Rails 74, 76, 78 and 80 are in turn joined at the corners of the board 70 by respective corner assemblies 84, 86, 88 and 90 utilizing glue posts 94 (FIGS. 5 and 6).

Figure 5:
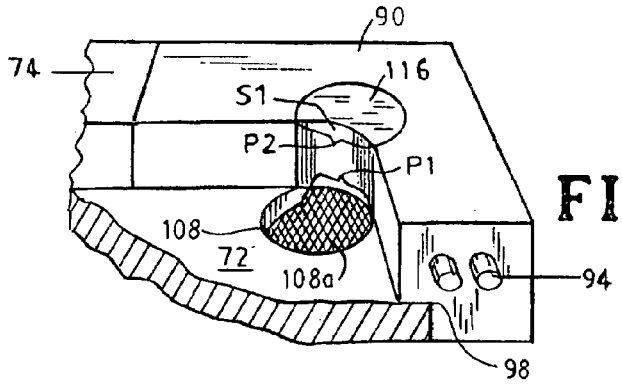
FIG. 5 is a perspective view of the improved corner construction of the invention with the vertically adjustable impact member shown in a position in which the bottom surface of the impact member resides in substantially the same plane as that of the surface on which the coins slide.
Figure 6:
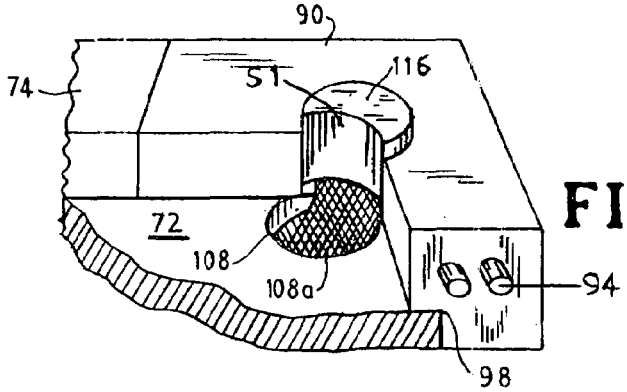
FIG. 6 is a perspective view of the improved corner construction of the invention similar to that shown in FIG. 5 but with the vertically adjustable impact member shown in a raised position.

A dado 98 indicated in FIG. 4 by the dashed line 99 and also seen in FIGS. 5 and 6, receives the peripheral edges of the bed 72 which itself is formed as a relatively thin sheet on the upper surface of which the game pieces slide. Pockets 102, 104, 106 and 108 are formed with nets 102*a*, 104*a*, 106*a* and 108*a* and are recessed into bed 72 at each of the four corners. The boundaries of the nets are generally indicated by the notations N5, N6, N7 and N8. The plane occupied by the outer periphery P1 (FIG. 5) of each of the respective pockets 102, 104, 106, and 108 substantially coincides with the inner plane P2 (FIG. 5) of impact surface S1 formed on each of the vertically adjustable impact members 110, 112, 114, and 116 at each corner of the game board 70. Each of the respective impact members 110, 112, 114 and 116 is snugly and slidably fitted in its own respective opening 110', 112', 114' and 116', the shape of which and relation to an adjoining pocket is best seen in later referred to FIG. 8.

By comparing FIGS. 5 and 6 it can be seen that the impact members 102, 104, 106 and 108 can each be either positioned in a relatively low position as in FIG. 5 or elevated to a relatively high position as in FIG. 6. Assuming a shot of a coin C as depicted in FIG. 4 is intended for pocket 108 it has been found that when impact member 108 is in its lowest position that positioning of the coin C in pocket 108 will be more difficult than will be the case when the same shot is intended but with impact member 108 in a raised position as in FIG. 6. Thus, by varying the elevation of the impact members 102, 104, 106, and 108 different degrees of difficulty in accomplishing a potential shot can be presented.

In a first embodiment, downward movement of the impact member is limited by forming the dado 98 with a shelf 100 as best seen in FIG. 8. The thickness of shelf 100 can be varied to vary the depth to which the impact member can be lowered, and thereby vary the difficulty of a particular shot.

In a second embodiment of the invention as seen in FIGS. 4–9, a representative impact member 120 is shown formed with a series of depressions 122 adapted to receive a ball member 124 loaded by a spring 126 so as to lock impact member 120 in one of several possible vertical positions so as to vary the difficulty of a shot and which can be selected as experience is gained.

In a third embodiment, impact member 120' is formed with a screw-thread 130 around the periphery thereof, except in the impact area of the impact member (see FIG. 12). In this embodiment, the inner surface of the opening 116' is also formed with matching threads (not shown). By rotating impact member 120' either clockwise or counterclockwise, impact member 120' is raised or lowered. Raising or lowering of impact member 120 is aided by internally formed finger grip 140 as seen in FIG. 12. An area in the top of impact member 120 has a scooped out area allowing the finger tips of the user to rest therein as finger grip 140 is held by the user's fingers.

In summary, it can be seen then that by providing vertical adjustment of an impact surface located outwardly of the pocket at each respective corner of the board substantial variation in difficulty of playing the game can be achieved.

What is claimed is:

1. An improved carromboard providing variation in difficulty of playing comprising:

(i) a rectangular carromboard the outer, peripherial sides of which are bounded by rails and over the flat, smooth surfaced bed on which flat, disc like game pieces slide;

(ii) a pocket comprising a hole formed in the board at a fixed position within the rails at each of four corners of the board and, below the hole, means for receiving and holding game pieces shot therein;

(iii) said rails at each said corner of the board being formed as part of a corner assembly; and (iv) each said corner assembly being formed with an opening located outwardly of the respective pocket hole associated with the assembly and in which is mounted a vertically adjustable impact member shaped to fit said opening, said member having an outwardly curved, impact surface facing the respective said hole and located in a curved plane which substantially coincides with the curved plane occupied by an outer portion of the periphery of the entry to a pocket therebelow whereby by adjusting the vertical position of said impact member, a variation in the difficulty of pocketing a game piece in a particular pocket hole can be varied.

2. An improved carromboard as claimed in claim 1 in which said corner assembly is of a form which enables it to be prefabricated and then assembled to said rails.

3. An improved carromboard as claimed in claim 1 including means operatively associated with said assembly which enables said impact member to be releasably fixed in a selected vertical position.

4. An improved carromboard as claimed in claim 1, in which said impact member is adapted to be positioned either below or above the level of the surface of said board.

5. An improved carromboard as claimed in claim 1 in which the lowest position in which said impact member is adapted to be positioned is substantially the same as the level of the surface of said board.

6. An improved carromboard as claimed in claim 1 in which the lowest position in which said impact member is adapted to be positioned is below the level of the surface of said board.

7. An improved carromboard as claimed in claim 1 in which said corner assembly including said impact member is molded of a plastic material.

8. An improved carromboard as claimed in claim 1 including a detent mechanism operatively associated with said impact member for releasably maintaining its vertical position.

9. An improved carromboard as claimed in claim 8 in which said corner assembly including said impact member is molded of a plastic material.

10. An improved carromboard as claimed in claim 1 wherein said opening and impact member for each said corner assembly are formed with mating thread formations which enable said impact member to be raised and lowered by the rotation of said impact member.

11. An improved carromboard as claimed in claim 1, wherein said impact member includes a finger grip formed in the top thereof.

12. An improved game board providing variation in difficulty of playing a game of the type in which a game piece is directed on the surface of a board towards a pocket with the intent of being held therein, comprising:

(i) a rectangular board the outer, peripherial sides of which are bounded by rails and over the flat bed of which game pieces are projected;

(ii) a pocket comprising a hole formed in the board at a fixed position within the rails of each of four corners of the board and, below the hole, means for receiving and holding game pieces shot therein;

(iii) said rails at each said corner of the board being formed as part of a corner assembly; and (iv) each said corner assembly being formed with an opening located outwardly of the respective pocket hole associated with the assembly and in which is mounted a vertically adjustable impact member shaped to fit said opening, said member having an outwardly curved, impact surface facing the respective said hole and located in a curved plane which substantially coincides with the curved plane occupied by an outer portion of the periphery of the entry to a pocket therebelow, whereby by adjusting the vertical position of said impact member, a variation in the difficulty of pocketing a game piece in a particular pocket hole can be varied.

* * * * *